US007568434B2

(12) United States Patent
Neale

(10) Patent No.: US 7,568,434 B2
(45) Date of Patent: Aug. 4, 2009

(54) DEVICE AND SYSTEM FOR SURVEILLANCE, SEARCH, AND/OR RESCUE

(76) Inventor: Jimmy Ross Neale, 9233 State Highway 59, Anderson, MO (US) 64831

( * ) Notice: Subject to any disclaimer, the term of this patent is extended or adjusted under 35 U.S.C. 154(b) by 0 days.

(21) Appl. No.: 10/889,091

(22) Filed: Jul. 12, 2004

(65) Prior Publication Data

US 2005/0005809 A1 Jan. 13, 2005

Related U.S. Application Data

(60) Provisional application No. 60/486,048, filed on Jul. 10, 2003.

(51) Int. Cl.
*B61B 3/00* (2006.01)

(52) U.S. Cl. ..... 104/127

(58) Field of Classification Search ..... 104/127–129, 104/124, 125, 106, 107
See application file for complete search history.

(56) References Cited

U.S. PATENT DOCUMENTS

| | | | | | |
|---|---|---|---|---|---|
| 1,791,904 | A * | 2/1931 | Riblet | 105/152 |
| 4,406,351 | A * | 9/1983 | Littlejohn et al. | 182/47 |
| 5,131,508 | A * | 7/1992 | Suzuki | 187/380 |
| 5,355,975 | A * | 10/1994 | Laurutis | 187/270 |
| 5,372,072 | A * | 12/1994 | Hamy | 104/93 |
| 5,967,265 | A * | 10/1999 | Bruno et al. | 187/201 |
| 6,050,198 | A * | 4/2000 | Gersemsky et al. | 105/30 |
| 6,318,503 | B1 * | 11/2001 | Hernandez | 187/239 |
| 6,598,706 | B1 * | 7/2003 | Takeuchi | 187/239 |

* cited by examiner

*Primary Examiner*—S. Joseph Morano
*Assistant Examiner*—Robert J McCarry, Jr.
(74) *Attorney, Agent, or Firm*—Spencer Fane Britt & Browne LLP

(57) ABSTRACT

The invention is a system that is movable along a guide. It includes housing having a center of mass, a first wheel and a second wheel, each connected to the housing and configured to rotate about a respective axis. Each axis is displaced from the center of mass to create a rotating moment that biases the first wheel and second wheels into frictional engagement with the guide. The invention also includes a rotator, and controls in communication with the rotator and positioned at a location remote from the housing. The housing moves relative the guide.

36 Claims, 13 Drawing Sheets

DEVICE AND SYSTEM FOR SURVEILLANCE, SEARCH, AND/OR RESCUE

CROSS-REFERENCE TO RELATED APPLICATIONS

This application claims benefit of U.S. Provisional Application Ser. No. 60/486,048, filed on Jul. 10, 2003.

BACKGROUND OF INVENTION

A convenient, efficient means of transporting a load over a distance where no existing means of transport is available has many applications. Perhaps most notably, a device or system capable of such transport can be used to extract people from inaccessible locations, such as from a high-rise building. The 9/11 disaster affirmed the need for a device or system capable from extracting people from a building when those people are trapped by structural failure, fire, or other circumstances. Though the 9/11 disaster is the most high-profile instance where a device or system in accordance with the present invention might have saved lives, such situations arise regularly. In San Juan, Puerto Rico, 86 lives were lost some years ago when the Dupont Plaza Hotel caught fire. In 1980, 85 people died when the MGM Grand Hotel in Las Vegas, Nev. burned. In the latter instance, lives were lost primarily due to poisonous gas and smoke rising through elevator shafts. Helicopters were used in both cases to lift people from rooftops, and a small number were saved using this method. But the availability of helicopters on alert and capable of lifting large numbers of people is small and, in some locales, may be non-existent. Additionally, the use of helicopters in the burning building environment presents an additional danger due to heat, smoke, and turbulence caused by fire and wind currents that normally exist around tall buildings.

In the case of the 9/11 disaster, elevators were unusable, leaving emergency stairwells or windows as the only means of escape from the building. Use of windows is unacceptable unless a fire truck ladder can reach the window in question, often not the case in extremely tall buildings. Stairwells are slow and firemen have to use the same stairs to reach the upper floors, leading to crowding in the stairwells such that firemen are hindering the movement of people down the stairwells and to the outside, and people fleeing the building hinder the movement of firemen up the stairway to fight the fire. Further, stairwells may not be an option for disabled persons, and moving injured people down a stairwell is difficult.

The need for a device or system of extracting people from buildings is not limited to a fire situation. Partial building collapse as a result of an earthquake or faulty construction can lead to a similar need. Partial collapse of a building causes survivors to be trapped on the upper floors where it is difficult and dangerous for them to attempt to extract themselves or for rescue personnel to reach them.

In addition to rescue scenarios, a need exists for an efficient, independent means of moving a load vertically or horizontally across a distance. For example, it is generally necessary to move loads across a distance during the construction of high-rise buildings, bridges, and the like.

In any of the scenarios above, it is desirable that the device or system of transport be truly independent in that it have its own power supply, means of locomotion, and the like. Such a device is also needed for transport of materials in space, or as a "space elevator." Also needed is a means of moving a load along mine shafts or extracting persons therefrom. In addition to extraction, there is also a need for a system or device for placing persons at a location or allowing surveillance therefrom. These and other needs are met by the present invention, as will be detailed more fully below.

SUMMARY OF THE INVENTION

The present device operates on the principle of utilizing a net torque on a roller pair to induce a normal force, at each roller, on the surface of a rail passing between the rollers. These normal forces in turn induce frictional forces between the rollers on the rail surface that allowed the applied torque to move the device up or down along the rail.

One embodiment of the present invention includes a system comprising a housing having a center of mass, and an endpoint distal the center of mass. This embodiment of the present invention preferably includes a first wheel configured to rotate about a first axis of rotation, and a second wheel connected to the housing and configured to rotate about a second axis. The second axis preferably runs generally parallel to the first axis. The first and second axes are displaced from the center of mass by a first distance and a second distance, respectively. The first distance may be either greater than or less than (but preferably not equal to) the second distance.

The configuration of the first and second axes with respect to the center of mass will create a rotating moment that biases both the first wheel and the second wheel into frictional engagement with a guide positioned between the first and second wheel. The guide will tangentially and frictionally engage of each of the first and second wheels. This embodiment of the present invention also preferably includes a rotator, and a first set of controls in communication with the rotator. The controls are positioned at a location remote from the housing.

This embodiment of the present invention also preferably includes an attachment connected to the housing. The attachment preferably includes a cage. The rotation of the first wheel causes the system to move relative to the guide. Optionally, the invention may include gear teeth on a perimeter of the first wheel and mating and meshing gear teeth on the rail.

In a preferred embodiment of the invention, the attachment includes a camera. In this preferred embodiment, the invention may also include a pole coupled to the surface of the housing, and the camera is mounted to the pole. Optionally, the pole may be telescoping so that its length may be selectively adjusted by operating a second set of controls that is positioned in a location remote from the housing.

Additionally, the camera may be rotatable to enable one to selectively receive images from a field spanning 360 degrees about a longitudinal axis of the pole. Additionally, the camera may be rotatable about an axis orthogonal to the longitudinal axis of the pole. In this embodiment, the second set of controls may also be configured to enable selective rotation of the camera about an axis orthogonal to the pole.

The invention may include a viewing device enabling one to view the images received by the camera. The invention may also include a recording device for storing and recording the images received by the camera. The camera may be any known type of camera, such as a round camera with a wide-angle field of vision. Further, it may be a video camera, a still camera, a digital camera, a heat-sensitive camera, a motion-sensing camera, or the like.

In a preferred embodiment of the invention, the guide is vertically oriented and positioned along a wall of a building, such as a wall of an elevator shaft, or an exterior surface of a building, for example. The invention may also include a cage connected to the housing, preferably at a point proximate the center of mass of the invention.

Another embodiment of the invention includes a housing having a general T-shaped cross-section having a center of mass located on the central, primary member of the T-shape. This embodiment of the invention includes a pair of first wheels, each respective first wheel being positioned on a respective crossing member of the T-shape. Each wheel of the first pair of wheels is configured to rotate about a first axis.

The invention may also include a pair of second wheels connected to the housing and configured to rotate about a second axis. The second axis is displaced from the center of mass, and is generally parallel to the first axis.

The invention may also include a rotator for rotating at least one driving wheel. In such an embodiment the driving wheel is preferably at least one wheel of the first pair of wheels; alternatively, the driving wheel may be at least one wheel of the second pair of wheels. The rotator is positioned within the housing. The invention may also include a first set of controls for selectively activating the rotator. The first set of controls may be positioned at a location remote from the housing.

One embodiment of the present invention will include a guide having a first rail and second rail spaced apart from the first rail, and oriented in a generally parallel manner thereto. In this embodiment, each of the first and second rails is positioned to frictionally and tangentially engage a perimeter of a respective one of the first pair of wheels, and a respective one of the second pair of wheels. The first and second rails are spaced apart, so that the crossing members of the T-shaped housing at behind the rails and the primary member of the T-shaped housing protrudes between the first and second rails.

A camera may be connected to the housing and, in such an embodiment, the invention preferably includes a second set of controls for selectively altering a viewing perspective of the camera. The second set of controls should be positioned at a location remote from the housing.

The invention may also include a viewer in communication with the camera and configured to display images input into the camera. The system moves along the rails by rotating at least one of the first wheels, thereby causing the housing to move relative the guide.

The invention may also include a cage connected to the housing on the primary member at a point distal the crossing members of the housing. The cage may be connected to the housing by cables. The first controls for selectively activating the rotator may be positioned in the cage.

The invention may also include a pole extending from the housing. In this embodiment, the camera is mounted to the pole. This pole may be telescoping, thereby enabling one to selectively alter its length. The camera may be selectively positioned to enable the viewing of a 360 degree field of vision about a longitudinal axis of the pole.

In a preferred embodiment, the rotator includes a hydraulic motor having a driving axle that is generally concentric with the first axis of rotation, namely the axis of the first pair of wheels.

The invention may also include gear teeth on the perimeter of each wheel of the first pair of wheels, and matching gear teeth on an inner face of each of the first and second rails. These mating and matching teeth facilitate relative movement of the housing with respect to the guide.

In a preferred embodiment, the camera is an infrared camera, or a heat-sensitive camera, or any type of known device capable of transmitting images when light is scarce, or ordinary vision is limited. From the perspective of the camera, the line of sight may limited or obstructed—first, by the wall of the building or by smoke or fire; second, by loss of power (and therefore loss of electricity and loss of artificial light). Of course, an ordinary camera may also be used.

Preferably, the guide is vertically oriented and positioned along a wall of a building. In this embodiment, the rail is traditionally coupled to the wall. Further, this embodiment includes a cage connected to the housing. The cage may have a bottom, and sidewalls extending upwardly therefrom. Optionally, a single wheel (or a pair of wheels) may extend from the cage to engage the wall.

The invention may also include a remotely controlled robot positioned proximate the cage, preferably within the cage. The robot should be equipped with apparatus to facilitate its mobility, and its mobility should be controllable from a location remote from the robot. The robot may also include a camera and an audio communication device. Preferably, the audio communication device enables two-way audio communication. Of course, a viewing or recording apparatus in communication with the camera on the robot would also be preferred, as would a recording device for storing the audio messages received on the robot. The robot may be entirely remotely controlled from the ground, or may be controlled by an operator on the cage.

Other objects, advantages and novel features of the present invention will become apparent from the following detailed description of the invention when considered in conjunction with the accompanying drawings.

DETAILED DESCRIPTION

Figure 1:
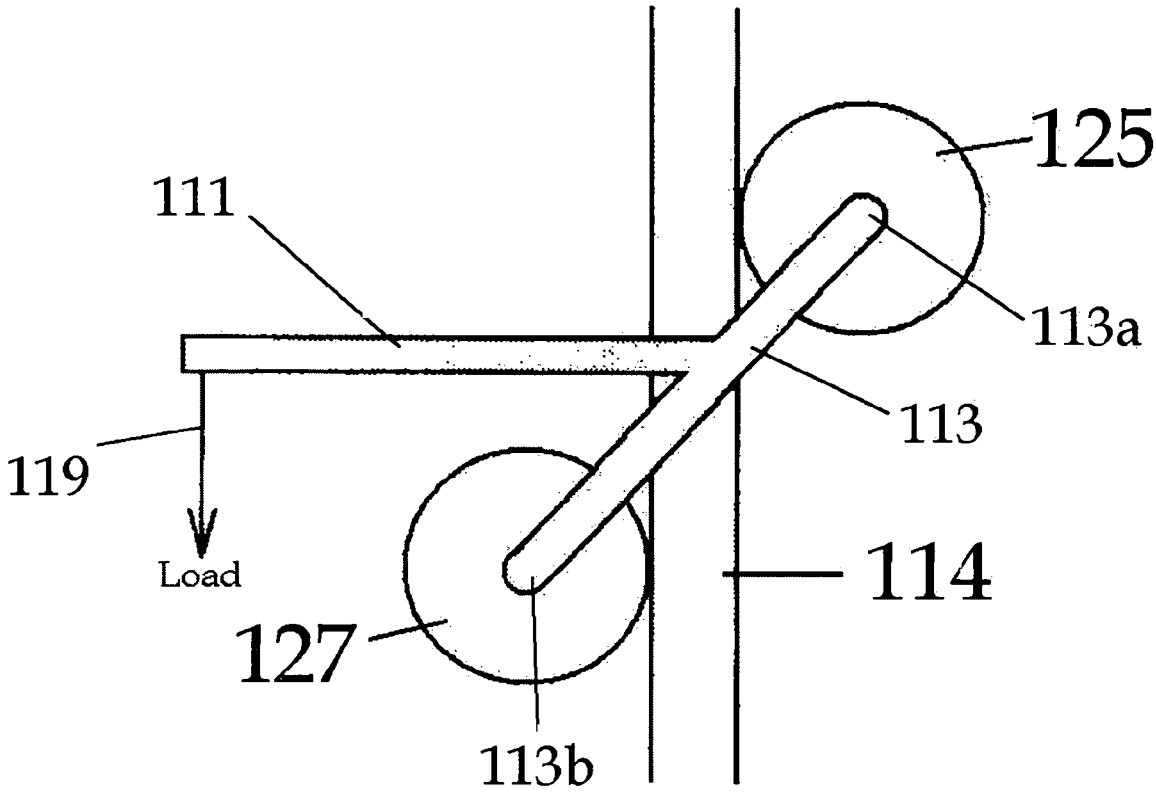
FIG. 1 is a schematic view of the underlying concept of the present invention.

Turning now to the drawings, wherein like numerals indicate like parts, FIG. 1 shows a schematic view of the concept underlying various embodiments of the present invention.

The present device operates on the principle of utilizing a net torque on a roller pair to induce a normal force, at each roller, on the surface of a rail passing between the rollers. These normal forces in turn induce frictional forces between the rollers on the rail surface that allowed the applied torque to move the device up or down along the rail.

FIG. 1 shows a rod or bar portion 111 extending from a load (not shown). At the end of bar portion distal the load, crossbar portion 113 is fixedly attached thereto and is disposed at an angle relative to bar portion 111 such that a first terminus 113*a* of crossbar portion 113 extends distally with respect to the load, while a second terminus 113*b* of crossbar portion 113 extends proximally with respect to said load. At first terminus 113*a* of crossbar portion 113, a first wheel 125 is fixedly and rotatably attached. At second terminus 113*b* of crossbar portion 113, a second wheel 127 is fixedly and rotatably attached. Disposed between said first and second wheels is a rail 114. Arrow 119 indicates the direction of gravitational force imposed on the system by the weight of the load. It is this force that causes a net torque on first wheel 125 and second wheel 127. This net torque in turn causes first wheel 125 and second wheel 127 to impose a normal force on rail 114. These normal forces induce frictional forces between said rail and said first wheel 125 and said second wheel 127. When first wheel 125 is rotated, such as, for example, by an electric motor, the device is able to move along rail 114 due to the frictional forces between rail 114 and first and second wheels 125 and 127. While the description above provides an understanding of the general principle of the present invention, various aspects of the invention will be described in greater detail below.

Figure 2:
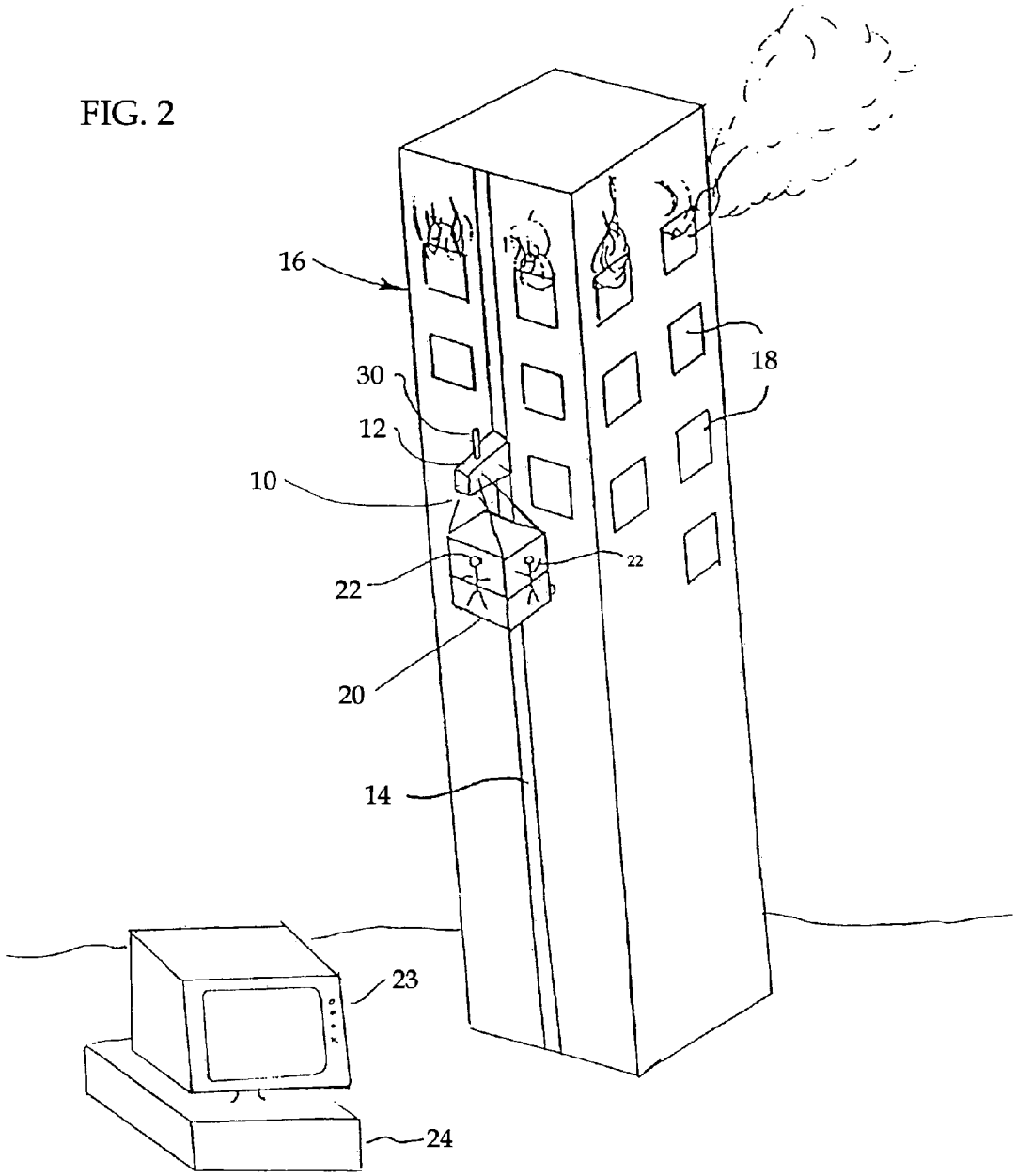
FIG. 2 is a perspective view of the system in use as a device to assist in the search and rescue of people, shown in accord with the principles of the invention.

FIG. 2 shows a perspective view of the inventive system in use as a search and rescue apparatus. The system 10 includes a housing 12 configured to engage within a guide 14 that is horizontally oriented and coupled to the side of a building 16. Indeed, the term "guide" as used herein, includes any device that acts to regulate or direct the motion or operation of system 10. Thus, while guide 14 is shown to be a rail-type guide mounted to building 16, guide 14 may also include other structures, such as a cord or cable, preferably a tautly drawn cable. In the event a cable is used, the system may be mounted to a surface by the placement of a grappling hook, which may be shot into position. Guide 14 may also be a T-shaped channel recessed into building 16 or another structure. The recessed T-shaped channel provides for aesthetic considerations that some may find desirable.

System 10 is able to vertically traverse a surface of building 16. A cage 20 may be attached to housing 12, which is selectively movable by a set of controls (not shown in FIG. 2) that may be positioned on cage 20 or a remote location, such as on the ground. In order to rescue people 22 from building 16, an operator aligns cage 20 with a window 18, allowing people 22 to escape a respective window and enter cage 20. As used herein, the term "cage" is intended to include any structure capable of ascending and descending along with the system without specific regard to its ability to provide an enclosure for its occupants. For example, a platform may suffice. System 20 preferably includes a camera 30 that allows one to view from above.

While vertically-oriented systems 10 are shown, the inventive system includes and extends to incorporate alternate orientations, such as a horizontally-mobile system, diagonally mobile systems, and the like. Further, system 10 may also be configured to accommodate varied shapes, such as spirals, curves and the like.

System 10 includes a viewing apparatus 23 and a recording device 24, both in communication with camera 30, enabling one to view images captured by camera 30 coupled to housing 12. When operated, viewed and controlled from a location remote from system 10, the invention allows a search and rescue team to locate, find, and reach stranded people 22 without imperiling the lives of the members of the rescue team. Of course, the system 10 may also be operated by a member of the team riding in cage 20.

In preferred embodiments, system 10 includes a cage 20 that may be coupled to housing 12 by a rescue team, which brings the special cage 20 in response to an emergency call. In such an embodiment, it is preferred to make the cage 20 capable of being quickly coupled to housing 12. It has been found that a coupling using a bull pin (not shown) and a snap-fit may work well; of course, cable-type attachments are also possible. System 10 would therefore require a guide 14 to be mounted to a building 16. Of course, system 10 may also be constructed so that cage 20 and housing 12 are formed as a single unitary, monolithic, one-piece structure that may be brought to the scene of an emergency.

Inventive system 10 has functional application in diverse environments. For example, system 10 may be coupled to large cruise ships, aircraft carriers or other vessels. System 10 may have applications in exploring or surveying wells, caves or mines. System 10 may also be used to enable repair or maintenance of very tall structures, such as tall monuments, radio communication towers, oil wells or platforms, or the like.

In order to enhance the safety of the system, it is also preferred that the system include a braking system, or a means for preventing injury in the event the system fails (failure may include, but is not limited to, the cage disconnecting from the housing, or the housing losing its grip on the rail). For example, the system may include a surface-engaging braking system that may slow a free-falling system.

Figure 3:
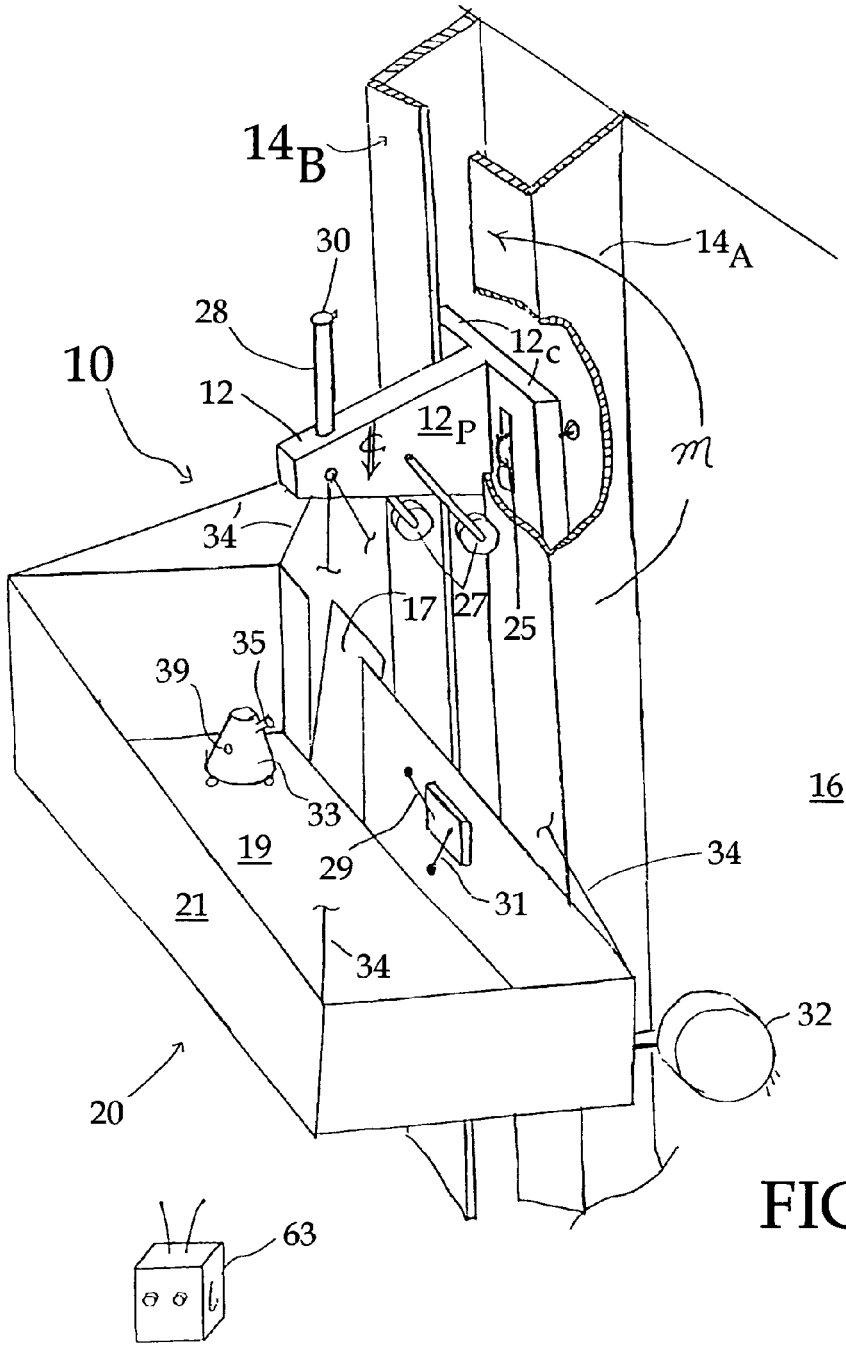
FIG. 3 is a perspective view of a first preferred embodiment of the system.

FIG. 3 shows a detailed view of one embodiment of housing 12 in combination with guide 14. As shown in FIG. 3, guide 14 comprises a first rail $\mathbf{14}_A$ and a second rail $\mathbf{14}_B$ in a spaced-apart relation. In alternative embodiments, guide 14 may comprise a single standard C-Channel beam, or may be constructed by a pair of spaced-apart I-Beams (See FIG. 10). Housing 12 bears a generally T-shaped cross-section with a primary member $\mathbf{12}_P$ and a crossing member $\mathbf{12}_C$. Housing 12 and guide 14 are cooperatively configured so that crossing member $\mathbf{12}_C$ is behind guide 14, and primary member $\mathbf{12}_P$ of housing 12 protrudes through the space between rails $\mathbf{14}_A$ and $\mathbf{14}_B$. As shown, housing 12 is configured to enclose its content; however, housing 12 need not provide an enclosure. Instead, a housing comprising an open bracket or frame wherein the content of housing 12 would be exposed is certainly within the scope of the invention. As such, the term "housing" as used herein is interchangeable with any frame, brace, bracket or support, and therefore need not necessarily provide an enclosure.

A first wheel 25 protrudes from a crossing member $\mathbf{12}_C$ of housing 12, and is therefore distal the center of mass C of housing 12. A second wheel 27 is connected to housing 12 along the primary member $\mathbf{12}_P$ of T-shaped housing 12. As used herein, the term "connected" should be construed to mean any linking of elements irrespective of whether direct contact between the connected parts exists. Rail $\mathbf{14}_A$ is positioned between first wheel 25 and second wheel 27 and tangentially and frictionally engages a perimeter of each of wheels 25 and 27. This configuration of wheels 25 and 27 with respect to the center of mass C of housing 12 creates a rotating moment M which biases first wheel 25 against an inner surface of guide 14, and likewise biases second wheel 27 against an outer surface of guide 14. Additionally, the moment M may be increased by attaching cage 20 to housing 12 at a point distal the center of mass C. This naturally-created moment M creates a locking effect, wherein housing 12 is held tightly onto guide 14. The biasing effect of a rotating moment M can be achieved with an alternate embodiment, which will be discussed in greater detail with respect to FIGS. 7 and 8 hereinafter. Additionally, the biasing effect may be created in ways alternative to the creation of a moment M, such as by any known biasing device such as a piston-type device or a spring.

As shown, a pole 28 is attached to housing 12, preferably to an upper surface of primary member $\mathbf{12}_P$. System 10 also includes a camera 30 connected to housing 12, preferably to pole 28. Camera 30 may be any known type of image-transmitting device, such as an infrared camera, night-vision camera, or a typical video and digital device. Further, millimeter wave scanners may supplement the system, either in addition to a camera or in lieu thereof. An example of a millimeter wave scanner is disclosed in U.S. Pat. No. 5,760,397 to Huguenin et al. U.S. Pat. No. 5,760,397 is therefore incorporated by reference as if set forth verbatim herein.

In this embodiment, system 10 may be used not only as a search and rescue apparatus, but also as a surveillance and security system. Security cameras may be mounted to the exterior or interior of various tall buildings or structures, allowing a wide panoramic view suitable for surveillance or security. One may remotely control not only the position of housing 12 but also the height of pole 28 and the angle of the camera 30 in order to selectively zoom in on or view a desired area. Of course, if used as a security or surveillance system, the cage 20 would not be needed.

Cage 20 of system 10 may also include a bottom 19 and sidewalls 21 extending therefrom. In a preferred embodiment, one sidewall 21 is equipped with a door 17 that is hinged to cage 20 adjacent its bottom 19. Of course, alternate or added placements of door 17 are possible. However, the placement of door 17 upon sidewall 21 facing building 16 enables door 17 of cage 20 to function as a ramp that provides access to cage 20 to and/or from building 16. Such a ramp would assist in helping people with reduced mobility, such as those confined to wheelchairs. Cage 20 may also include a second door (not shown) positioned at an alternate location enabling people to exit cage 20.

Cage 20 may be connected to housing 12 by any known method, such as cables 34, chains, or posts. As aforementioned, the cage and housing may be formed as a single unitary, monolithic, one-piece structure. In any regard, it is preferred to attach cage 20 to housing 12 using a quick and easy method, such as by using a bull pin type of attachment. A first set of controls 29 for operating a rotator (not shown in FIG. 3) turns first wheel 25, thereby selectively adjusting the position of housing 12 relative to guide 14. A pair of wheels 32 engages a wall of the building; as shown, each wheel 32 is positioned adjacent opposing ends of cage 20.

A second set of controls 31 may be positioned within cage 20 and in communication with camera 30, thereby enabling a person within cage 20 to maneuver camera 30 and selectively alter the field of vision.

Controls 29 and 31 may also be positioned at a remote location, such as on the ground, enabling one to maneuver system 10 and camera 30 from the remote location. This configuration that allows remote viewing and remote control of cage 20 enables a team to find stranded people, and send cage 20 to save people without imperiling members of a rescue team. Of course, an operator of system 10 riding within cage 20 may also control elements of system 10.

System 10 may also be equipped with a mobile robot 33 having a camera 35 and an audio communication device 39 mounted thereon. Robot 33 may also include a heat seeking device capable of detecting "hot spots" such as people or fire. Communication device 39 may, of course, be configured to enable two-way audio communication. Preferably, robot 33 is in communication with a remote control device 63 for selectively moving robot 33.

Thus, system 10 may be entirely remotely controlled, as it has the capability of locating and rescuing people from great heights without imperiling a rescue crew. For example, one may remotely move housing 12 (and consequently the entire system) up a skyscraper building. Using camera 30 mounted to the housing, one can search for people who need assistance. Door 17 may be lowered, and robot 33 may be moved from cage 20 and into a window 18 (see FIG. 2) of building 16.

Thus, robot 33 could help search for stranded people by moving about the interior of a building. Robot 33 may be placed into building 16 by one operating cage 20, or it may be remotely controlled to enter the building. If people are located using robot 33, audio device 39 could be used to communicate with the stranded people. Of course, remote control device 63 should include (or be supplemented by) separate viewer communication hardware that would enable receipt of the images and sounds detected by robot 33. Robot 33 and remote control device 63 may be battery operated, and communication there between may be by any known method such as infrared or radio communication.

Figure 4:
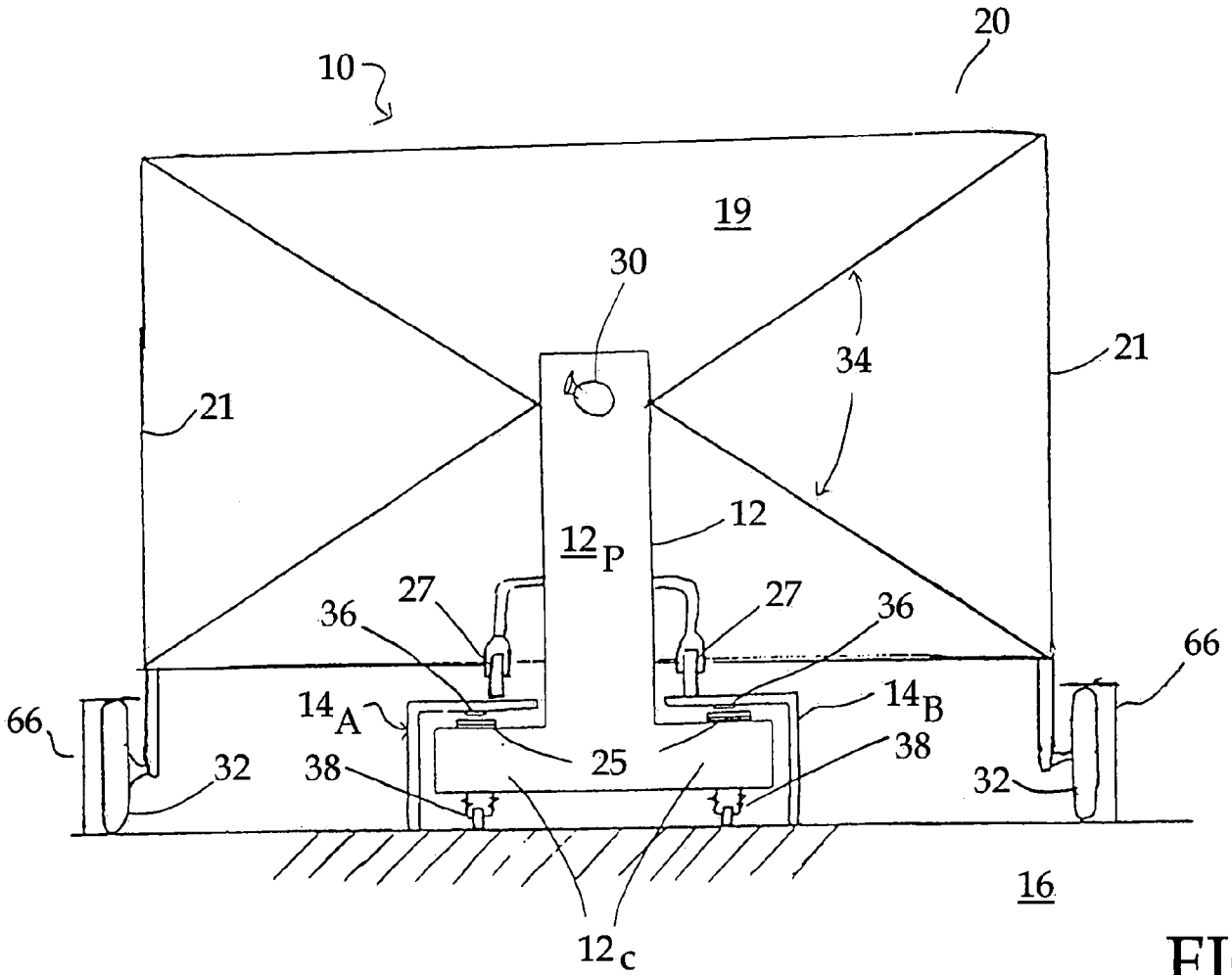
FIG. 4 shows a top view of the first preferred embodiment of the system.

FIG. 4 shows a top view of a first embodiment of system 10. This embodiment of system 10 includes a cage 20 having a bottom 19 and sidewalls 21 extending upwardly therefrom. Connectors, such as cables 34 connect cage 20 to a housing 12 preferably at a point on primary member $\mathbf{12}_p$ of the housing 12. Cage 20 is further equipped with a pair of wheels 32 engaging within a pair of tracks 66 positioned in a general parallel and spaced-apart relation to guide 14. Tracks 66 should be positioned and configured so that wheels 32 are retained within tracks 66 as the system moves relative guide 14. Tracks 66 are one option—albeit, a costly option—for increasing the stability of system 10. Structural alternatives for accomplishing increased stability at a greatly reduced cost are discussed hereinafter.

A pair of first wheels 25 are positioned on a front face of crossing member $\mathbf{12}_c$ of housing 12, and a pair of second wheels 27 are connected to the housing on primary member $\mathbf{12}_p$ of housing 12. A camera 30 is shown coupled to an upper surface of primary member $\mathbf{12}_p$ of housing 12; alternate placement of camera 30 is also possible, of course.

An inner face of each rail $\mathbf{14}_A$ and $\mathbf{14}_B$ will tangentially and frictionally engage a perimeter of each of first 25 and second 27 wheels. In one embodiment, the wheels frictionally grip the surface of the rail, much like a tire gripping the road. As such, wheels 25 and 27 may be equipped with tread. In the embodiment shown, however, first wheel 25 bears teeth 36 that complement and mate with gear teeth on a perimeter of each of first wheels 25. Crossing member $\mathbf{12}_C$ of housing 12 is behind rails $\mathbf{14}_A$ and $\mathbf{14}_B$, and primary member $\mathbf{12}_P$ protrudes outwardly from a space between rails $\mathbf{14}_A$ and $\mathbf{14}_B$. The configuration of wheels 25 and 27, together with the center of mass C (see FIG. 3) and the weight of cage 20 cooperate to create a rotating moment M (see FIG. 3) which tends to bias first wheel 25 against the inner surface of guide 14, and also bias second wheels 27 into contact with an outer surface of guide 14.

In order to further assist in this biasing effect that maintains first wheels 25 in contact with gear teeth 36 positioned on an inner surface of guide 14, a biasing wheel 38 may be positioned on an outer surface of crossing member $12_C$ of housing 12. It is also possible that the biasing moment M could impose such a tight lock onto guide 14 that system 10 is difficult to move. Optionally, system 10 may include a device for resisting the natural moment M by exerting forces in an opposite direction.

Figure 5:
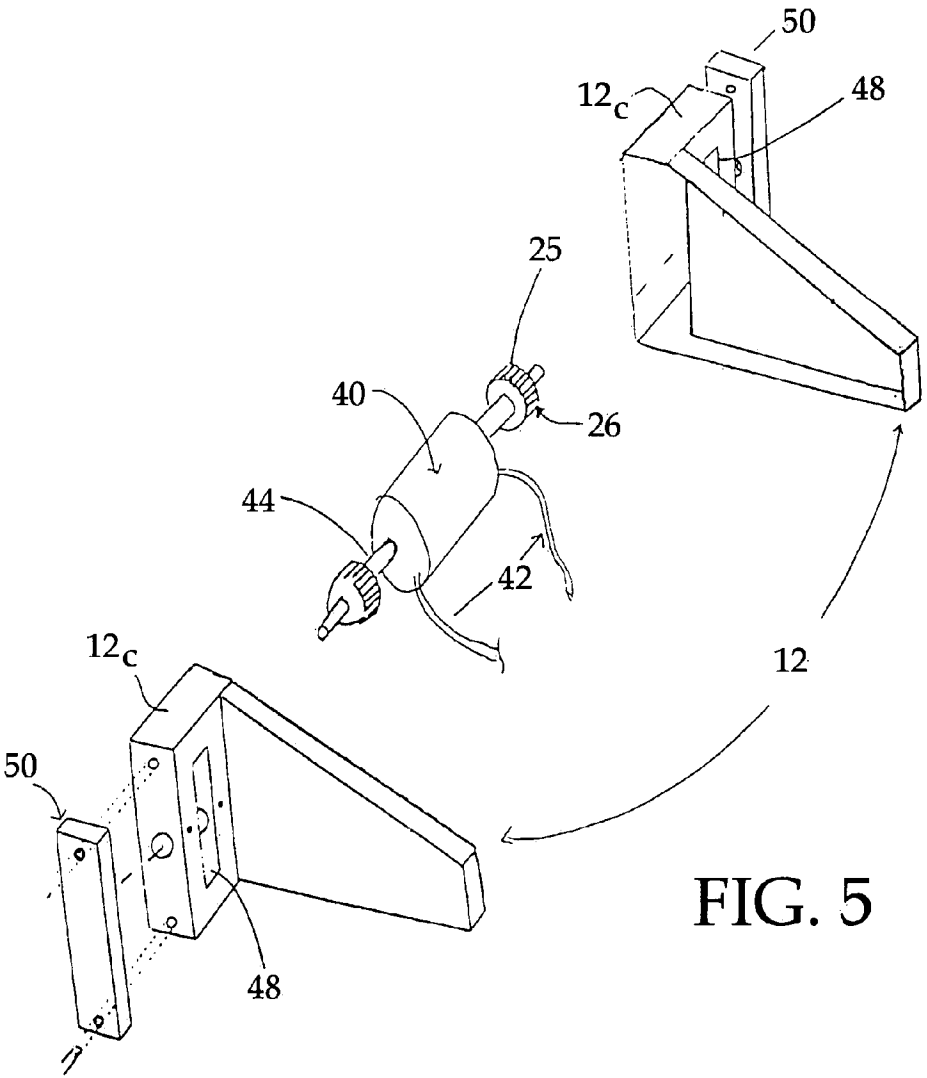
FIG. 5 is an exploded view showing the housing and its content, shown in combination with the first preferred embodiment of the system.

FIG. 5 shows an exploded view of the first embodiment of system 10, showing housing 12 and detailing its content. A rotator 40 inside housing 12 rotates first wheels 25. Rotator 40 may include a hydraulic motor, an electric motor, or a fuel-operated motor. Generally, rotator 40 has a driving axis generally concentric with the longitudinal axis of the motor. It is preferred that rotator 40 be entirely self-contained so that power or motive force is not required from any source exterior the system.

In many instances, system 10 will be used to climb buildings having no power or electricity access, or when the power sources have been destroyed or shut down. Therefore, it is preferred that the system be configured with its own self-contained power source that will enable it to move along guide 14, even if power from external sources is unavailable. A first axle 44 passes through rotator 40, and is symmetrically and concentrically connected to each wheel of first pair of wheels 25. Gear teeth 26 are configured on a perimeter of each of wheels 25 in order to complement, mesh and mate with gear teeth on an interior surface of guide 14 (as shown FIG. 4).

In an alternate embodiment, rotator 40 may be in communication with second wheels 27. In this embodiment, gear teeth (not shown) are on a perimeter of second wheels 27, and meet and mesh with gear teeth on an outer surface of the rails $14_A$ and $14_B$.

Hydraulic motors are well known in the art; it is also known to have dual shafted motors, wherein each shaft is concentric with a longitudinal axis of the motor. Examples of this concentric configuration may be found in U.S. Pat. No. 4,907,495 to Sugahara, and may be also be found in U.S. Pat. No. 5,704,434 to Schoeps. Each of these patents, Sugahara '495 and Schoeps '434, is incorporated by reference into this specification as if set forth verbatim herein.

If rotator 40 includes a hydraulic motor, fluid lines 42 will lead to a pump that forces fluid into rotator 40. Alternatively, if rotator 40 is chosen to include an electric motor, lines 42 will lead to positive and negative terminals, respectively, of a current source such as a battery (see FIG. 6). Whichever type of rotator 40 is selected, it is preferred, as stated herein, that rotator 40 be powered by a source that is self contained, which will enable the system 10 to move without an external power source to provide motive torque.

First wheels 25 protrude from an opening 48 formed on a surface of crossing members $12_C$ of housing 12. Axle 44 will run through the interior of the crossing members $12_C$ of housing 12, and will pass through apertures formed in housing 12. End plates 50 cover the end surfaces of the crossing members, and protect the ends of axle 44.

Figure 6:
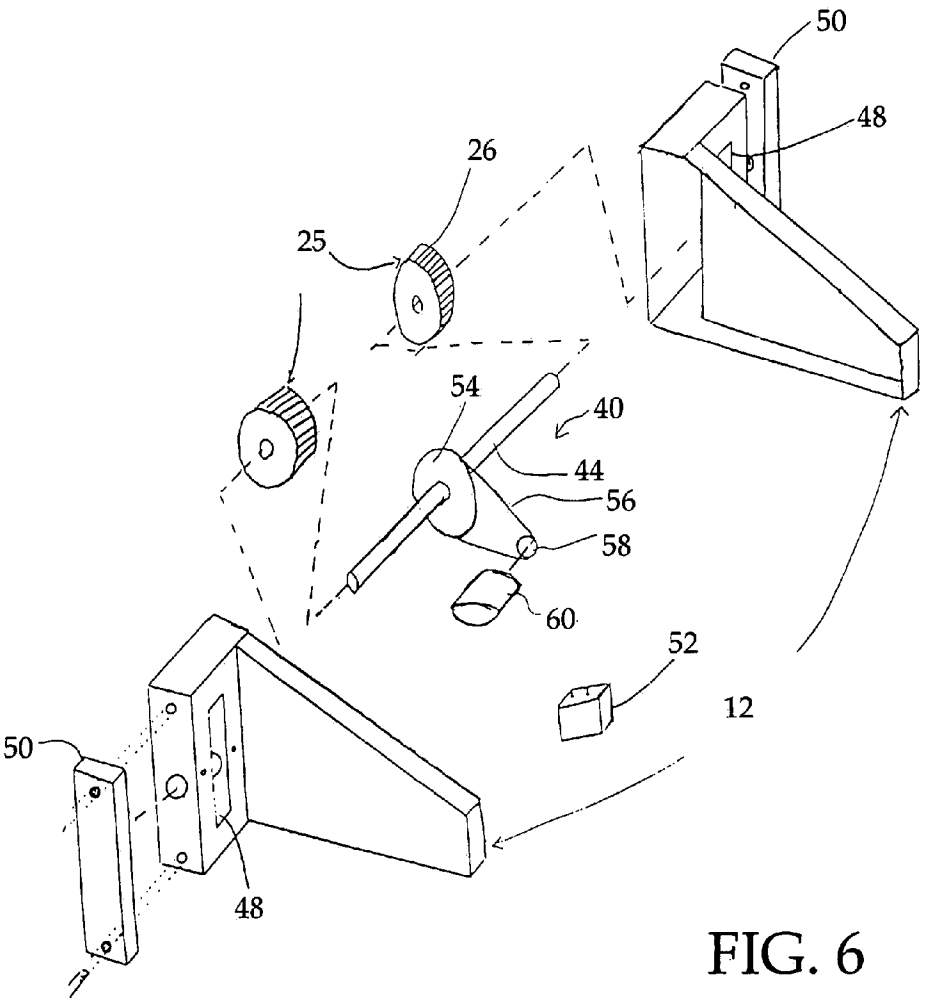
FIG. 6 is an exploded view showing the housing and an alternate version of content, shown in combination with the first preferred embodiment of the system.

FIG. 6 shows an exploded view of the first embodiment of housing 12 and another version of its content. In this embodiment, rotator 40 has a sprocket 54 and chain 56 combination, or a wheel and belt combination, attached to a motor 60. Sprocket 54 is coupled to axle 44 so that the turning of sprocket 54 also rotates first wheels 25. Rotator 40 may include a motor 60 that may be powered by a current source, such as a battery 52, or rotator 40 may include any known type of motor, such as a diesel or internal combustion engine.

The driving shaft of motor 60 turns a driving link 58 of sprocket 54 and belt or chain 56 combination, thereby imparting rotating torque to axle 44 which is transferred to each of wheels 25. The remaining aspects of housing 12, including the opening 48, the apertures, and the end plates 50 are analogous to the parts that are discussed in prior FIG. 5.

Figure 7:
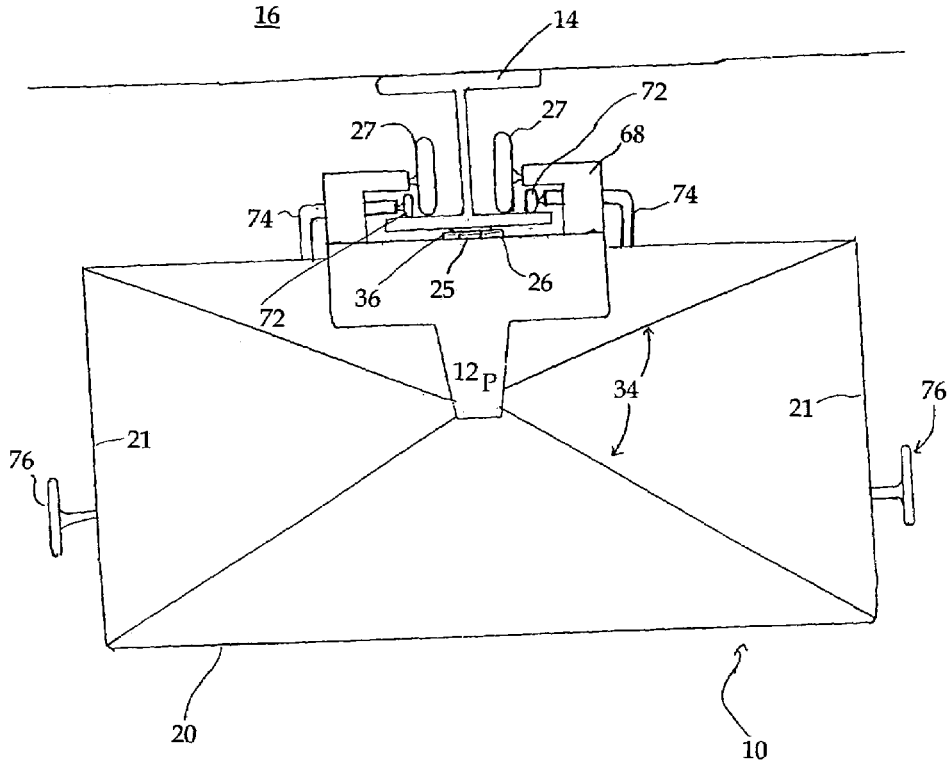
FIG. 7 shows a top view of a second preferred embodiment of the system.

FIG. 7 shows an overhead view of a second preferred embodiment of system 10. In this embodiment, guide 14 is a single rail, such as a standard I-Beam. Indeed, system 10 may incorporate a guide 14 made of any type of beam, rail or track that is standard in the industry, thereby reducing costs by eliminating the need for custom-made parts. A guide 14 formed of a beam that is standard in the industry will simplify the system by enabling existing structures to be retro-fitted with inventive system 10. Housing 12 is shown to be generally T-Shaped; however, alternate shapes are certainly within the scope of this invention.

A pair of struts 68 extend in a general orthogonal direction from end portions of crossing members $12_C$ of housing 12. A pair of first wheels 27 are rotatably mounted to struts 68 and engage an inner surface of guide 14.

Housing 12 will have a slot (not shown in FIG. 7; see FIG. 9) that enables a perimeter of first wheel 25 to protrude therethrough. First wheel 25 preferably has gear teeth 26 on its perimeter. Gear teeth 26 on first wheel 25 are cooperatively configured to mate and mesh with gear teeth on an outer surface of guide 14.

A cage 20 may be coupled to housing 12 at a point distal to wheels 25 and 27. The weight of cage 20—and the weight of any occupants, of course—will create a rotating moment that creates a 'locking effect' wherein each of wheels 25 and 27 is biased against a surface of guide 14.

Cage 20 may be coupled to housing 12 by cables 34; of course, other coupling means are certainly possible. Cage 20 may also include an additional pair engaging a surface of building 16. Optionally, a pair of tracks (not shown) may be coupled to building 16 and positioned in a parallel and spaced-apart relation to guide 14. An extra set of tracks, however, would require the placement of additional rails, and would also require a pair of wheels (for example, as shown in FIG. 4) configured to roll within the additional rails. As shown in FIG. 7, however, cage 20 may include a pair of wheels 76 positioned along a side wall 21 of cage 20 to facilitate movement and transportation of cage 20.

The embodiment discussed in the preceding paragraph, however, requires the installation of additional rails. This addition, of course, adds cost and labor expense to the task of fitting system 10 to new or existing structures. In order to avoid this expense and accomplish a similar movement-confining result, cage 20 may be equipped with a wheel mount 74 extending from cage 20, and a pair of wheels 72 coupled to wheel mount 74. The wheels 72 are configured to engage an interior surface of guide 14 and roll within guide 14 as cage 20 is moved relative guide 14. Wheel mount 74 and wheels 72 cooperate to allow movement along the longitudinal axis of guide 14 and simultaneously restrict movement in other directions.

Figure 8:
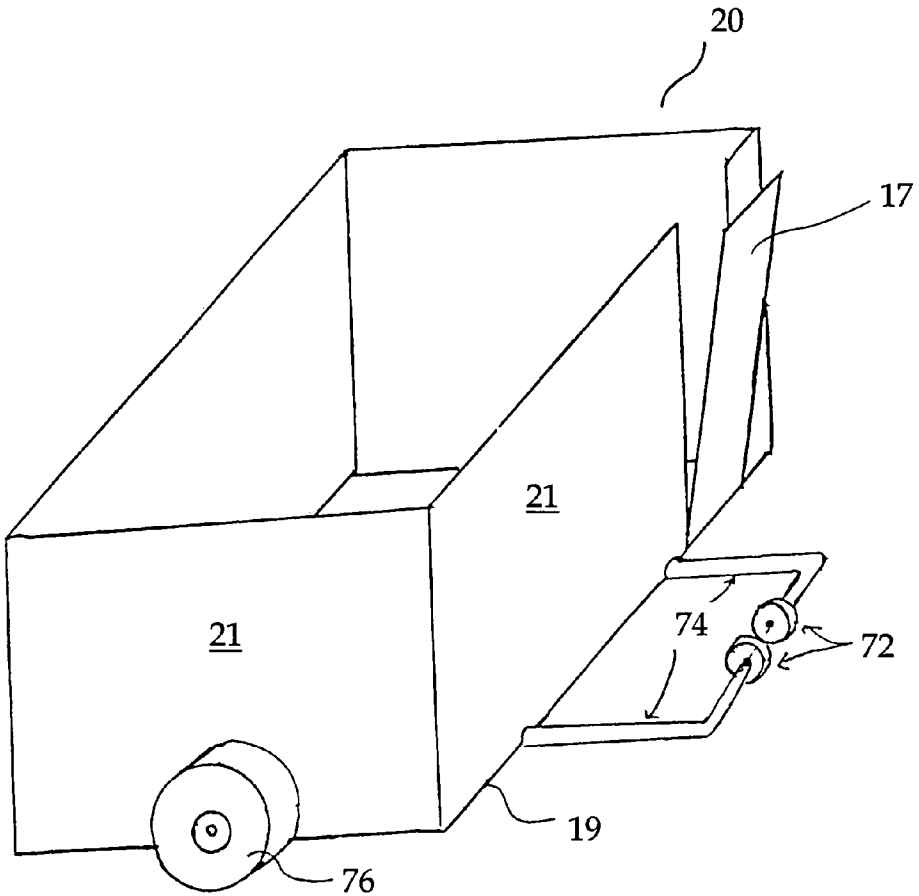
FIG. 8 shows a perspective view of the cage that is depicted in FIG. 7.

FIG. 8 shows a perspective view of the embodiment of cage 20 that was shown in FIG. 7, isolating cage 20 from the remainder of system 10. Wheel mount 74 extends from a wall 21 of cage 20, preferably adjacent the bottom 19 of cage 20.

In this embodiment, wheel mount 74 comprises a pair of spaced apart struts. The struts should be spaced sufficiently apart to accommodate the width of guide 14 (not shown in FIG. 8; see FIG. 7). Additionally, wheels 72 should be placed so that each engages an interior surface of guide 14 (as shown in FIG. 7). It is preferred that an engaging surface of wheels 72 and the engaging surface of wheels 27 (on the housing) simultaneously engage the inner surface of guide 14 as cage 20 moves relative guide 14 (see FIG. 7). In order to accomplish this simultaneous engagement of wheels 27 and 72 with the inner surface of guide 14, wheel mount 74 may contain a biasing means. Preferably, the wheel mount may be rotatably biased about an axis parallel to the bottom edge of cage 20.

As discussed above, pair of wheels 76 assists in the transportation of cage 20 when the system is not configured to move along guide 14. For example, a rescue team may bring cage 20—or the entire system 10—with them in response to an emergency. Wheels 76 will assist in rolling cage 20 into a position wherein cage 20 could be added to system 10. Preferably, the ground engaging surface of wheels 76 will be generally coplanar with the ground-engaging surface of wheels 72, easing the task of rolling cage 20 (which may be quite heavy) into place. Of course, additional wheels (or pairs of wheels) that are similarly attached to cage 20 are within the scope of the invention. Moreover, wheels 72 attached to cage 20 may be driven by a power source, enabling one to drive cage 20 along the ground in order to position system 10 such that it may be connected to guide 14.

Figure 9:
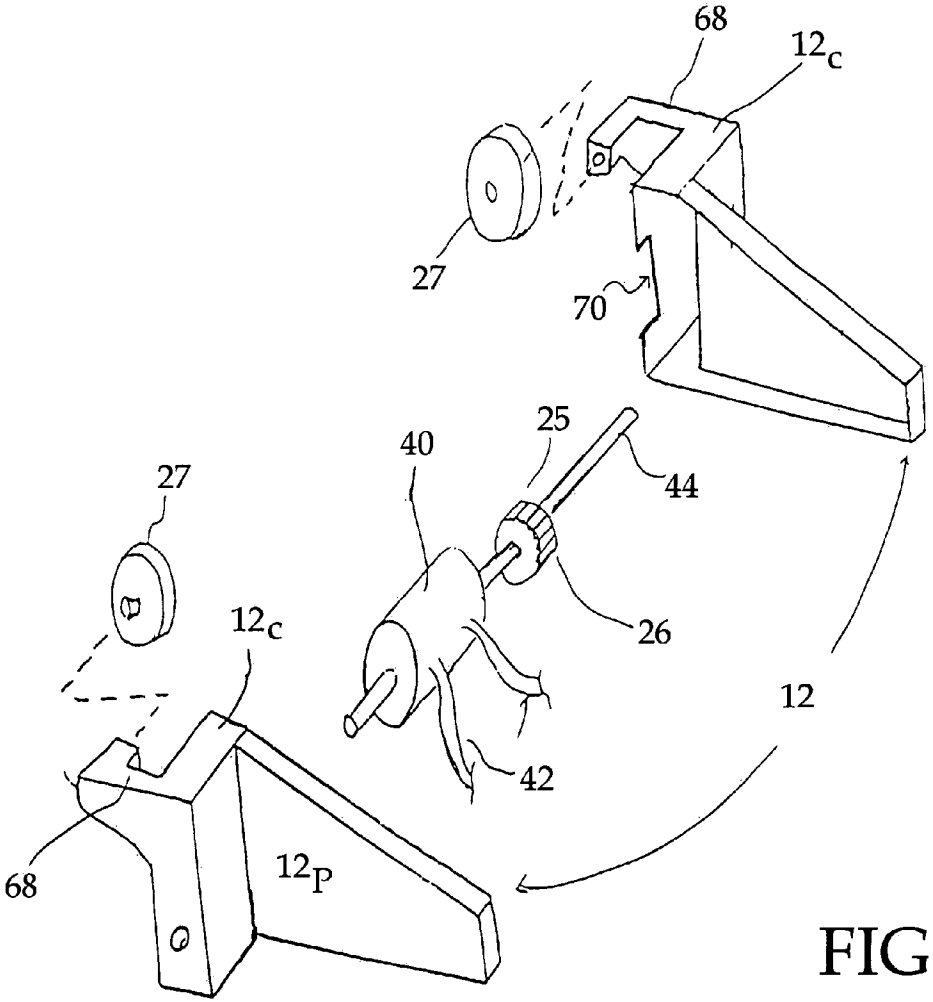
FIG. 9 is an exploded view showing the housing and its content, shown in combination with the second preferred embodiment of the system.

FIG. 9 provides an exploded view of the second preferred embodiment of the invention that was shown in FIG. 7, showing housing 12 and its content. In many ways, the aspects of the second embodiment of system 10 are analogous to the aspects of the first embodiment shown in FIGS. 3-6. Therefore, identical reference numbers have been assigned to analogous parts.

The embodiment shown in FIG. 9 preferably bears a single first wheel 25 having teeth 26, wheel 25 protruding through a slot 70 formed in the housing. A rotator 40 is positioned within an interior portion of housing 12 rotates first wheel 25. Rotator 40 may comprise a hydraulic motor having a driving axis generally concentric with the longitudinal axis of the motor, or may be an electric motor of the same or similar configuration. Gear teeth 26 on first wheel 25 complement, mesh and mate with gear teeth on an exterior surface of guide 14 (as shown FIG. 7).

Rotator 40 is preferably contained within housing 12. As shown, axle 44 runs through wheel 25 and may be held in apertures near opposite ends of housing 12. Of course, alternative methods or means for fixing the rotator within housing 12 are certainly possible.

Alternately, rotator 40 may be in communication with second wheels 27. In this embodiment, gear teeth (not shown) are on a perimeter of second wheels 27, and meet and mesh with gear teeth on an inner surface of the guide 14.

Figure 10:
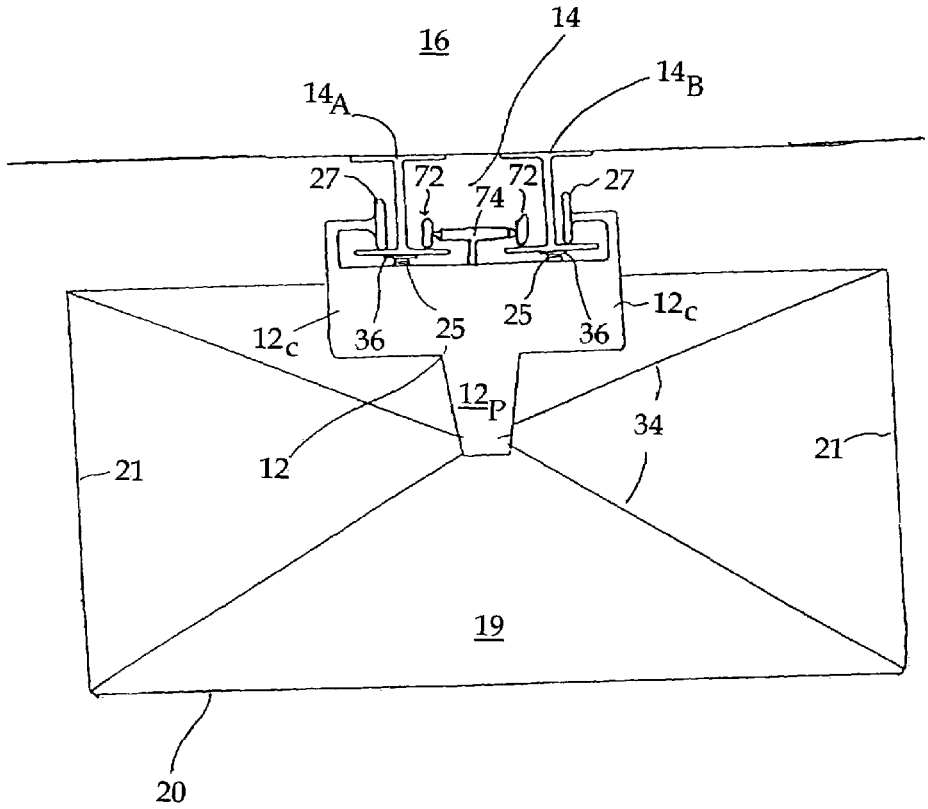
FIG. 10 is an overhead view of a third preferred embodiment of the system.

FIG. 10 shows a top view of a third preferred embodiment of the invention. This embodiment of system 10 incorporates many of the same features and limitations as the first preferred embodiment. In order to establish continuity and ease of understanding, analogous parts are given identical reference numbers.

In this embodiment, guide 14 is constructed by the parallel placement of rails $\mathbf{14}_A$ and $\mathbf{14}_B$; the rails may be standard I-Beams mounted to a surface such as a wall of a building 16. In this embodiment, first wheels 25 are mounted on respective crossing members $\mathbf{12}_C$ of housing 12. A perimeter of each of first wheels 25 engages an outer surface of a respective rail $\mathbf{14}_A$, $\mathbf{14}_B$. First wheels 25 and rails $\mathbf{14}_A$ and $\mathbf{14}_B$ are cooperatively configured with gear teeth 36 that mesh and mate with one another.

Housing 12 is further equipped with a pair of second wheels 27 connected to crossing members $\mathbf{12}_C$ of housing 12. Second wheels 27 rotate about an axis that is further from the center of mass of housing 12 than first wheels 25. The perimeter of each of second wheels 27 engages an inner surface of a respective rail $\mathbf{14}_A$, $\mathbf{14}_B$. Thus, the respective rails $\mathbf{14}_A$, $\mathbf{14}_B$ are positioned so that each passes between a respective first wheel 25 and second wheel 27.

In this embodiment shown in FIG. 10, system 10 moves relative guide 14 by rotation of at least one of first wheels 25. Alternatively, second wheel 27 may also be driven by a rotator 40. In that regard, a rotator (See FIG. 8) should be positioned within housing 12 in order to compel rotation and therefore urge relative motion.

Cage 20 may be coupled to housing 12, preferably on primary member $\mathbf{12}_P$ of housing 12. As mentioned above, myriad methods exist for connecting cage 20 to housing 12; cables 34 are shown, but other coupling and/or connecting methods are possible and within the scope of the invention.

Optionally, system 10 may include wheels (not shown in FIG. 10) configured to engage the surface 16. These wheels may further enhance the safety of the system by further limiting unwanted movement, tipping, blowing, or slipping while in use. One way of preventing such would be to position a pair of tracks (see Ref No. 66 in FIG. 4) in a generally parallel and spaced apart relation to guide 14.

Figure 11:
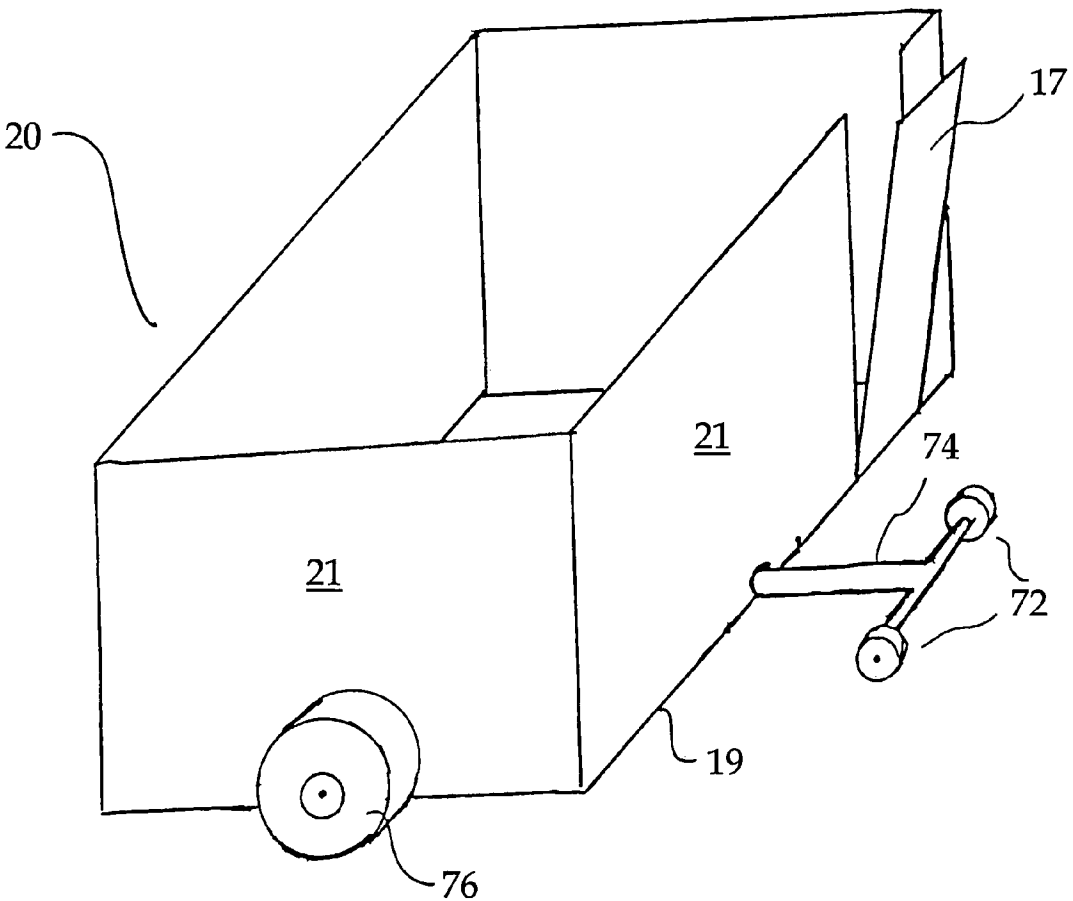
FIG. 11 shows a perspective view of a variation of the cage that is depicted in FIG. 10, shown with side wheels.

FIG. 11 shows a perspective view of the embodiment of cage 20 that was shown in FIG. 10, isolating cage 20 from the remainder of system 10. In many ways, this embodiment of cage 20 is identical to cage 20 as shown in FIG. 8. In that regard, analogous parts have been assigned identical reference numbers, for the sake of simplicity.

A notable distinction from this embodiment of cage 20 is the configuration of wheel mount 74 and wheels 72. While the embodiment shown in FIG. 11 only depicts a pair of wheels 72, it is within the scope of this invention to include additional pairs of wheels (not shown) that would enable a rescue team to roll cage 20 along the ground. In this embodiment, the wheel mount comprises a single post extending from a side wall 21 of the cage. A pair of struts extend in a general orthogonal direction from the single post, and terminate with wheels 72. This embodiment allows the post to pass through the space between parallel rails $\mathbf{14}_A$ and $\mathbf{14}_B$ of guide 14 (as shown in FIGS. 3 and 10) Additionally, wheels 72 should be placed so that each engages an interior surface of guide 14 (as shown in FIGS. 3 and 10). It is preferred that an engaging surface of wheels 72 (connected to cage 20) and the engaging surface of wheels 27 (connected to the housing) simultaneously engage the inner surface of guide 14 as cage 20 moves relative guide 14 (see FIG. 7). In order to accomplish this simultaneous engagement of wheels 27 and 72 with the inner surface of guide 14, wheel mount 74 may contain a biasing means. Preferably, the wheel mount may be rotatably biased about an axis parallel to the bottom edge of cage 20.

As with the embodiment in FIG. 8, the pair of wheels 76 assists in the transportation of cage 20 when not connected to guide 14.

Figure 12:
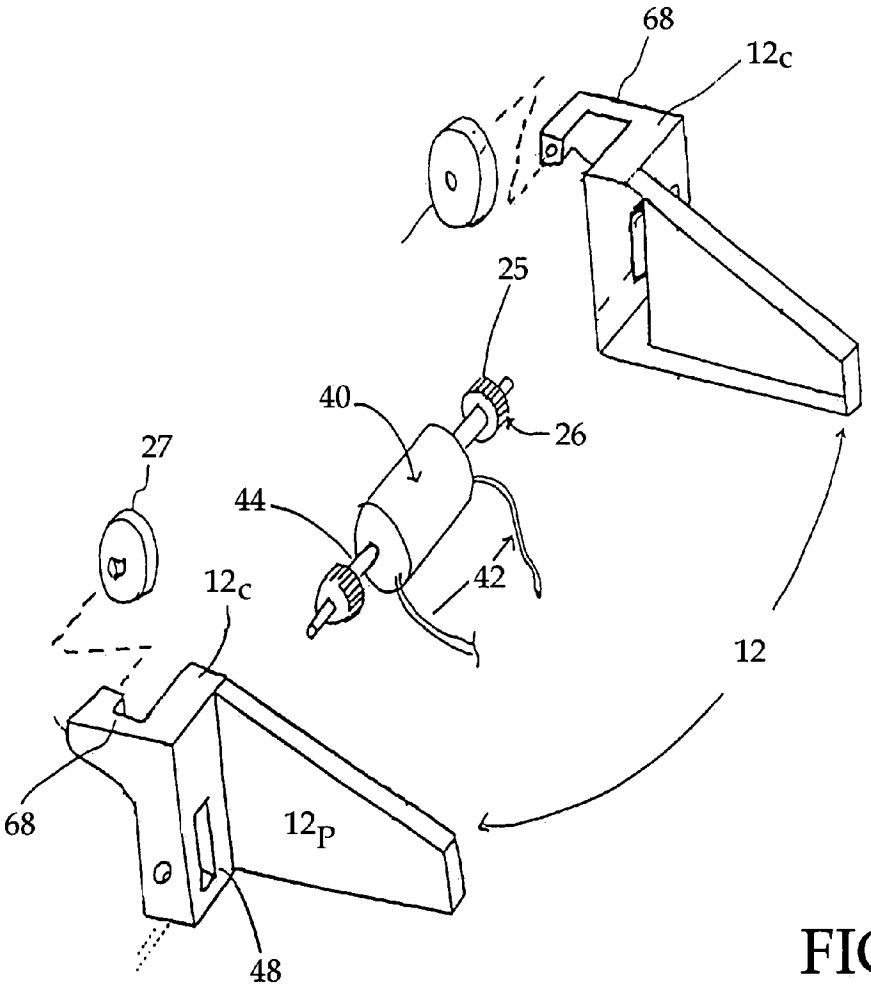
FIG. 12 is an exploded view of the housing and its content, according to the third preferred embodiment of the system.

FIG. 12 provides an exploded view of the embodiment of the invention that was shown in FIG. 10, showing housing 12 and its content. In many ways, the aspects of the second embodiment of system 10 are analogous to the aspects of the first embodiment. Therefore, identical reference numbers have been assigned to analogous parts.

A rotator 40 positioned within an interior portion of housing 12 rotates first wheels 25. Rotator 40 may include a hydraulic motor having a driving axis generally concentric with the longitudinal axis of the motor, or may be an electric motor of the same or similar configuration. A first axle passes through rotator 40, and is symmetrically and concentrically connected to each of the first pairs of wheels 25. Gear teeth 26 are configured on a perimeter of each of wheels 25 in order to complement, mesh and mate with gear teeth on an exterior surface of guide 14 (as shown FIG. 10).

In an alternate embodiment, rotator 40 may be in communication with second wheels 27. In this embodiment, gear teeth (not shown) are on a perimeter of second wheels 27, and meet and mesh with gear teeth on an inner surface of rails $\mathbf{14}_A$ and $\mathbf{14}_B$.

If rotator 40 is chosen to include a hydraulic motor, then fluid lines 42 will lead to a pump that forces fluid into rotator 40. Alternatively, if rotator 40 has an electric motor, then lines 42 will lead to positive and negative terminals, respectively of a current source such as a battery (shown in FIG. 6).

First wheels 25 protrude from an opening 48 formed on a backward-facing surface of the crossing members $\mathbf{12}_C$ of housing 12. Axle 44 will run through the interior of the crossing members $\mathbf{12}_C$ of housing 12.

A pair of second wheels 27 are connected to respective crossing members $\mathbf{12}_c$ of housing 12. Crossing members 12, may be equipped with struts 68 that extend from crossing members $\mathbf{12}_c$ in order to allow free rotation of first wheels 25 about an axis.

Figure 13:
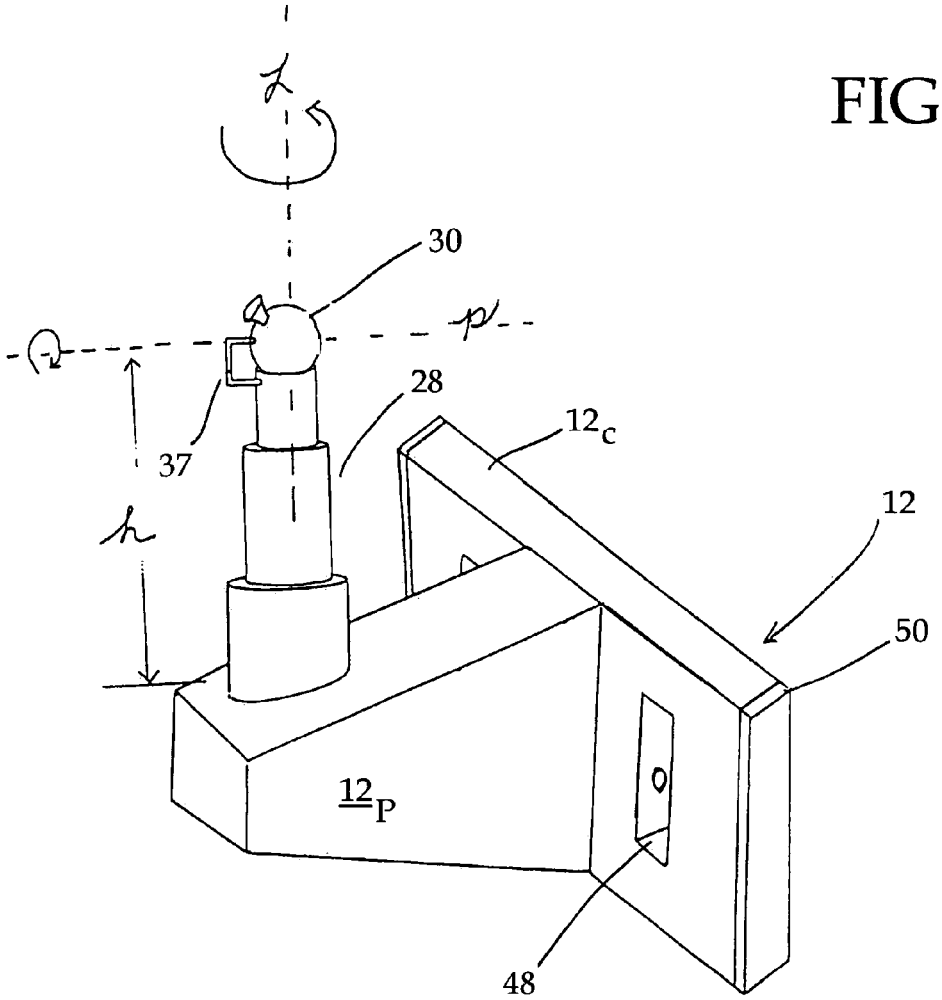
FIG. 13 is a perspective view showing a detail of the housing, pole, and camera, shown in combination with the first preferred embodiment.

FIG. 13 shows a perspective view that focuses upon the relation of housing 12 and camera 30. The view shown in FIG. 13 shows housing 12 and camera 30 in combination with the embodiment(s) of FIGS. 2-6; however, it is to be understood that the features explained with regard to FIG. 13 could also be incorporated into any of the embodiments shown herein.

A telescoping pole 28 is mounted on an upper surface of primary member $\mathbf{12}_P$ of housing 12. Of course, alternative placement of the pole is certainly possible and within the scope of the invention. Telescoping pole 28 enables one to adjust the height h separating housing 12 from camera 30. Generally, height h may be adjusted by operating the second set of controls 31 (see FIG. 3). Camera 30 is rotatable about a first axis L generally parallel to a longitudinal axis of pole 28. This rotation of camera 30 may be achieved by making one or more segments of pole 28 rotatable with respect to housing 12.

A coupling member 37 connects an upper portion of telescoping pole 28 to the camera and has rotation of the camera about an axis p. Generally, the axes p and L are orthogonal to one another in order to increase the field of vision attainable by camera 30.

Though specific embodiments of the device have been described above, the underlying concept of the present invention may be applied to various situations not detailed above without departing from the scope of the present invention. For example, scientists have been involved in recent years formulating plans for a space elevator as an efficient way to move materials and/or persons into space. Once these materials or persons are out of the earth's gravity, it is significantly cheaper to move them from one location to another, or to distant locations such as the moon or mars, as compared to moving the entire load from the ground into space via conventional means such as rockets. The present device could be utilized as the motive means for moving a load along a space elevator.

The U.S. Navy requires a means for moving a load along a horizontal distance on aircraft carriers. The present device is well-suited to that task, as certain embodiments of the device can be attached to or removed from a guide as desired, allowing a load to be moved along a guide when necessary without the need for a device that is a permanent part of the carrier. The device would also serve well for use in oil platforms for many of the same reasons.

In terms of insertion or surveillance, a free-standing guide could be employed at various locations where insertion or surveillance may be desired. Such a guide would be readily taken apart and/or moved. The portability of the present device, then, allows for easy insertion or individuals at remote locations, as well as for the creation of surveillance "towers" consisting of the guide of the present device as well as a platform or cage, as described above, from which individuals may watch.

Although the present invention has been described and illustrated in detail, it is to be clearly understood that the same is by way of illustration and example only, and is not to be taken by way of limitation. The spirit and scope of the present invention are to be limited only by the terms of the appended claims.

I claim:

1. A system comprising:

a housing having a center of mass;

a first wheel configured to rotate about a first axis of rotation, the first wheel being displaced a first distance from the center of mass;

a second wheel connected to the housing and configured to rotate about a second axis that is displaced from the center of mass by a second distance and generally parallel to the first axis;

a guide tangentially engaging a perimeter of each of the first and second wheels and positioned such that said guide is at least partially located between said first and second wheels;

wherein, positioning of each of the first and second axes with respect to the center of mass creates a rotating moment that biases the first wheel and second wheel into frictional engagement with the guide;

a rotator for rotating the first wheel;

a first set of controls in communication with the rotator and positioned at a location remote from the housing;

an attachment including a cage connected to the housing;

wherein, the rotation of the first wheel causes the system to move relative the guide.

2. The system as in claim 1, wherein the first wheel is a gear having teeth that mesh and mate with teeth positioned on the guide.

3. The system as in claim 1, wherein the attachment further includes a camera.

4. The system as in claim 3, further including a second set of controls positioned in a location remote from the housing and configured to selectively position the camera.

5. The system as in claim 3, further including a pole connecting the camera to the housing; and wherein the camera is selectively rotatable about at least one of an axis that is generally orthogonal to the pole;

or, the longitudinal axis of the pole.

6. The system as in claim 1, wherein the housing and the cage are formed as a unitary, monolithic, one piece structure.

7. The system as in claim 1, the cage further including a door that is selectively positionable between a closed position, wherein the door is flush with a side wall of the cage; and, an open position, wherein the door extends from the cage and forms a ramp leading onto the cage.

8. The system as in claim 1, further including at least one third wheel connected to the cage and positioned adjacent a bottom of the cage, the third wheel allowing the cage to roll in an upright position along a surface generally parallel to the bottom.

9. The system as in claim 1, further including a wheel mount extending from the cage; and, at least one fourth wheel positioned on the wheel mount and configured to engage an inner surface of the guide as the system moves relative the guide.

10. The system as in claim 1, wherein the rotator is positioned inside the housing.

11. The system as in claim 1, wherein the rotator includes a hydraulic motor with a driving axle that is concentric with the first axis.

12. The system as in claim 1, further comprising a biasing means coupled to the housing and configured to bias the first wheel into contact with the guide.

13. The system as in claim 1, further comprising a remotely controllable robot;

a camera connected to the robot;

a remote control in communication with the robot for selectively positioning the robot;

a viewer in communication with the camera enabling one to remotely view images captured by camera.

14. The system as in claim 13, further comprising an audio communication device positioned on the robot and enabling one to listen to sounds through the device.

15. The system as in claim 14, wherein the audio communication device enables two-way audio communication.

16. A movable system, comprising:

a housing having a general T-shaped cross-section, the T-shape bearing a primary member and a pair of crossing members extending generally orthogonally from the primary member and adjacent an end of the primary member, the housing having a center of mass within the primary member;

a pair of first wheels, each respective first wheel being positioned on a respective crossing member, and configured to rotate about a first axis;

a pair of second wheels connected to the housing, each of the second wheels being configured to rotate about a respective axis that is displaced from the center of mass and generally parallel to the first axis;

a rotator for rotating a driving wheel comprising at least one wheel of the first pair or second pair of wheels, the rotator being positioned within the housing;

a first set of controls for selectively activating the rotator, the first set of controls being positioned at a location remote from the housing;

a guide having a first rail and a second rail spaced apart from the first rail, each of the first and second rails being positioned to pass between the axis of the first wheels and the axes of the second wheels, each of the respective rails configured to frictionally and tangentially engage a perimeter of a respective one of the first pair of wheels and a respective one of the second pair of wheels;

a camera connected to the housing, and a second set of controls for selectively altering a viewing perspective of the camera, the second set of controls being positioned at a location remote from the housing;

wherein, the rotation of the driving wheel causes the housing to move relative the guide.

17. The system as in claim 16, further comprising a space between the first and second rails so that the crossing members of the housing are behind the rails and the primary member of the housing protrudes outwardly from behind the rails and passes through the space between the first and second rails.

18. The system as in claim 16, further comprising a pair of struts, each extending from a respective distal end of each crossing member of the housing; and, each second wheel is mounted to a respective strut.

19. The system as in claim 16, wherein each first wheel engages an inner surface of a respective rail, and each respective second wheel engages an outer surface of the respective rail.

20. The system as in claim 16, further comprising gear teeth positioned on a perimeter of at least one first wheel; and, gear teeth positioned on a surface of the guide;

wherein, the respective gear teeth on the at least one first wheel complement, mate and mesh with the gear teeth on the guide.

21. The system as in claim 16, further comprising a cage connected to the housing;

a wheel mount extending from the cage toward the guide; and, at least one third wheel mounted to the wheel mount and configured to engage an inner surface of the guide.

22. The system as in claim 16, further comprising a telescoping pole connecting the housing to the camera.

23. The system as in claim 16, further comprising a pole connecting the camera to the housing, wherein the camera is rotatable about at least one of:

a longitudinal axis of the pole;

an axis generally orthogonal to the longitudinal axis of the pole.

24. The system as in claim 16, wherein the rotator includes a hydraulic motor having a driving shaft generally concentric with the axis of rotation of the pair of first wheels.

25. The system as in claim 16, wherein the guide is positioned along a surface comprising a wall or ceiling of a building and the system further includes a cage connected to the housing, the cage having a bottom and side walls extending upwardly therefrom, and a pair of wheels extending from the cage and engaging an inner surface of the guide.

26. A system comprising:

a housing having a pair of spaced-apart struts, each respective strut extending in a general orthogonal direction from an upper portion of a rear face of the housing;

a first wheel displaced a first distance from a center of mass of the housing and configured to rotate about a first axis of rotation;

a pair of second wheels, each rotatably coupled to a respective strut such that each wheel rotates about a respective axis that is displaced from the center of mass of the housing, each respective axis being displaced by a length greater than the first distance, and generally parallel to the first axis;

a cage connected to the housing at a connection point such that the center of mass of the housing is between the first axis and the connection point;

a guide tangentially engaging a perimeter of each of the first wheel and each wheel of the pair of second wheels and positioned such that said guide is at least partially located between said first and second pair of wheels;

wherein, positioning of each first wheel and the pair of second wheels with respect to the center of mass creates a rotating moment that biases the first wheel and each of the pair of second wheels into frictional engagement with the guide;

a rotator positioned within the housing and configured to rotate the first wheel;

a first set of controls in communication with the rotator and positioned at a location remote from the housing;

gear teeth on a perimeter of the first wheel and cooperatively configured to mate and mesh with teeth on a surface of the guide;

wherein, the rotation of the first wheel causes the system to move relative the guide.

27. The system as in claim 26, further comprising a slot formed in the rear face of the housing;

and, the perimeter of the first wheel protrudes outwardly from the slot.

28. The system as in claim 26, further including a camera connected to the housing.

29. The system as in claim 28, further including a pole connecting the camera to the housing.

30. The system as in claim 29, wherein the pole is telescoping so that its length is selectively adjustable by operating a second set of controls that is positioned in a location remote from the housing.

31. The system as in claim 29, wherein the camera is rotatable about at least one of:

a longitudinal axis of the pole; or an axis generally orthogonal to the pole.

32. The system as in claim 26, the cage further including a door that is selectively positionable between a closed position, wherein the door is flush with a side wall of the cage; and, an open position, wherein the door extends from the cage and forms a ramp leading onto the cage.

33. The system as in claim 26, wherein the guide is positioned along a wall, and the system further includes:

a third wheel extending from the cage and configured to engage an inner surface of the guide;

the third wheel rolls within the guide as the cage moves relative the wall.

34. The system as in claim 26, further including a remotely controllable robot;

a second camera connected to the robot;

a remote control in communication with the robot for selectively positioning the robot;

a viewer in communication with the second camera enabling one to remotely view images captured by the second camera;

and, a two-way audio communication device positioned on the robot.

35. A system including a housing having general T-shaped cross-section, the T-shape bearing a primary member and a pair of crossing members extending generally orthogonally from an end of the primary member, the housing having a center of mass within the primary member;

a pair of first wheels, each respective first wheel being positioned on a respective crossing member, and configured to rotate about a first axis;

a pair of second wheels connected to the housing and configured to rotate about a second axis, the second axis being displaced from the center of mass and generally parallel to the first axis;

a rotator for rotating a driving wheel that includes at least one wheel of the first pair of wheels or second pair of wheels, the rotator being positioned within the housing;

a first set of controls for selectively activating the rotor, the first set of controls being positioned at a location remote from the housing;

a guide comprised of a first rail and a second rail spaced apart from the first rail, each of the first and second rails being positioned to frictionally engage and tangentially engage a perimeter of a respective one of the first pair of wheels and a respective one of the second pair of wheels;

gear teeth on a perimeter of one of the first pair of wheels, and mating and complementary gear teeth on an inner face of each of the first and second rails;

the first and second rails being spaced-apart so that the crossing members of the housing are behind the rails and the primary member of the housing protrudes between the first and second rails;

a first camera connected to the housing, and a second set of controls for selectively altering a viewing perspective of the first camera, the second set of controls being positioned at a location remote from the housing;

a viewer in communication with the first camera and configured to enable one to view images input into the first camera;

a recording device configured to record and retain images received by the camera a cage connected to the housing and having a bottom, and side walls extending upwardly therefrom, and a third pair of wheels extending from the cage and engaging the surface; a door on a side wall and pivotally coupled to the cage adjacent the bottom and configured to be selectively positionable between a first position, wherein the door is flush with the side wall, and, a second position, wherein the door extends to become a ramp into the cage; a second set of controls in communication with the first camera and configured to selectively position the first camera;

a robot;

a second camera connected to the robot; a two-way audio communication device connected to the robot; a third set of controls in communication with the robot enabling an operator to selectively position the robot; a second viewing apparatus in communication with the second camera;

wherein, the rotation of the driving wheel causes the housing to move relative the guide.

36. A system comprising:

a housing having a center of mass;

a first wheel configured to rotate about a first axis of rotation, the first wheel being displaced a distance from the center of mass;

a second wheel connected to the housing and configured to rotate about a second axis that is displaced from the center of mass by a second distance and generally parallel to the first axis;

a guide positioned between the first and second wheels and tangentially engaging a perimeter of each of the first and second wheels;

wherein, positioning of each of the first and second axes with respect to the center of mass created a rotating moment that biases the first wheel and second wheel into frictional engagement with the guide.

* * * * *